United States Patent [19]

Kaneaki et al.

[11] 4,380,184

[45] Apr. 19, 1983

[54] ELECTRONIC MUSICAL INSTRUMENT

[75] Inventors: Tetsuhiko Kaneaki, Ashiya; Kazuhiko Murase; Junnosuke Shigeta, both of Hirakata, all of Japan

[73] Assignee: Matsushita Electrical Industrial Co., Ltd., Osaka, Japan

[21] Appl. No.: 254,152

[22] Filed: Apr. 14, 1981

[30] Foreign Application Priority Data

Apr. 17, 1980 [JP] Japan ..... 55-51216
Apr. 18, 1980 [JP] Japan ..... 55-52035

[51] Int. Cl.[3] ..... G10H 5/06
[52] U.S. Cl. ..... 84/1.01; 84/DIG. 11
[58] Field of Search ..... 84/1.01, DIG. 11

[56] References Cited

U.S. PATENT DOCUMENTS 3,610,799 10/1971 Watson ..... 84/1.01
4,282,785 8/1981 Obayashi et al. ..... 84/1.01

*Primary Examiner*—Stanley J. Witkowski
*Attorney, Agent, or Firm*—Wenderoth, Lind & Ponack

[57] ABSTRACT

An electronic musical instrument has a generator assigner for supplying note data and octave data by key stroke entry, a top octave synthesizer for generating 12 of the highest pitch signals for each note, a circuit for selecting one highest pitch signal from the 12 highest pitch signals according to note data, a binary counter for dividing one highest pitch signal to produce several pitch signals, and circuits for selecting one pitch signal out of several pitch signals obtained by the binary counter. The circuits are further controlled by both octave data and note data to generate octave series tone signals and non-octave series tone signals such as quint series tone signals.

7 Claims, 11 Drawing Figures

GENERATOR ASSIGNER
KEYBOARD
TO OTHER TG
KEY-ON SIGNAL
OCTAVE DATA
NOTE DATA
NOTE SELECTOR
BINARY COUNTER
OCTAVE SELECTOR
KEYER
SELECTOR
FROM GA
TONE GENERATORS
TOS

ELECTRONIC MUSICAL INSTRUMENT

BACKGROUND OF THE INVENTION

1. Field of the Invention

This invention relates to an electronic musical instrument to an (EMI), especially EMI provided with a limited number of tone generators (called a key assigner system) which generates tone signals of various feet. In the EMI, there are tone signals such as 16', 8', 4' (defined here as octave series), and tone signals such as $5\frac{1}{3}'$, $2\frac{2}{3}'$ (defined as non-octave series in this description).

2. Description of the Prior Art

The tone signals generated in the non-octave series, for instance $5\frac{1}{3}'$, is 7 semi-tones higher than the tone signal of 8'. In other words, the tone signal generated as $5\frac{1}{3}'$ when the key for note C is pressed, has the same frequency of the tone signal generated in 8' when the key for note G is pressed. To generate the non-octave series tone signals in a usual EMI with the key assigner system, for example, to generate the quint series tone signal such as $5\frac{1}{3}'$ or $2\frac{2}{3}'$, it is necessary to obtain the highest signal which has a frequency 3 times higher than the highest pitch signal necessary in usual octave series tone generators. There then must be a divider to divide such a signal by 2 to supply the non-octave series tone generator (TG), and another divider to divide the signal by 3 to supply the octave series TG. A binary counter in each TG then divides the highest pitch signal supplied to each TG to obtain the tone signals.

Therefore, there is a problem with respect to the tone signals generated by the system described above: such signals are pure temperament and not temperament (the standard) and the frequency is different between temperament and pure temperament. Moreover, because the frequency of the highest pitch signal is 3 times higher than usual, it is necessary to use high speed devices.

On the other hand, printed circuit boards are often shared. FIG. 1 shows the usual EMI using the key assigner system. Referring to FIG. 1, element 1 is the keyboards. Element 2 is a generator assigner (GA). GA 2 detects the key stroke and selects a TG not being used out of several TGs then, GA 2 supplies the assignment signals which consist of (1) note data which represents the note name of the tone signal to be generated by the TG, (2) octave data which represents the octave number of the tone signal to be generated by the TG, and (3) a key-on signal which indicates that the key is being pressed. GA 2 may be a circuit which has the same function described in Japanese Patent Publication No. 50-33407/1975 which corresponds to U.S. Pat. No. 3,610,799. Element 3 is a top octave synthesizer (TOS) which generates the 12 highest pitch signals corresponding to each note (C, C#, - - - , B). Element 4-1 through 4-n are tone generators which generate tone signals according to the assignment signals supplied by the GA 2. Element 5 is a note selector and is controlled by note data supplied by GA 2 so as to select one highest pitch signal out of the 12 highest pitch signals supplied by TOS 3. Element 6 is a binary counter. Binary counter 6 consists of 7 stages of toggle flip flops, and is arranged so as to divide the highest pitch signal (applied by a note selector 5) into 7 pitch signals. The frequency of the outputs from terminal Q0 through Q6 follows the equation below:

$$(\text{output from } Qn) = 2 \cdot (\text{output from } Qn+1) \quad (1)$$

where $0 \leqq n \leqq 5$.

Element 7-1 through 7-4 are octave selectors which select one pitch signal out of 7 pitch signals supplied by the binary counter 6. The octave data is applied to the octave selectors 7-1 through 7-4 as the control input. Element 8-1 through 8-4 are keyers which control the amplitude of the pitch signals supplied by the octave selectors 7-1 through 7-4. The busbar selectors 9-1, 9-2, and 9-3 distribute the pitch signals applied by the keyers 8-2 through 8-4 to the output terminals specified by the assignment signals (octave data). Tone color filters are connected to each output terminal.

The operation of the circuit shown in FIG. 1 is as follows:

When a key is pressed, GA 2 supplies the assignment signal to the TG which is not otherwise being used. Every key is determined by note name and octave number. In this embodiment, GA 2 supplies note data, octave data and key-on signal. The note data consists of a 4 bit digital signal N0, N1, N2, N3 as shown in Table 1. The octave data consists of a 2 bit digital signal $\overline{O1}$, $\overline{O2}$ as shown in Table 2. The key-on signal indicates that the key is being pressed.

On the other hand, when TG 4-1 receives the assignment signals, at first, the note selector 5 selects one highest pitch signal out of the 12 highest pitch signals supplied by TOS 3 according to the note data N3 through N0. The binary counter 6 divides the highest pitch signal selected by note selector 5 and outputs 7 pitch signals from output terminals Q0 through Q6. The octave selectors 7-1 through 7-4 determine the range of pitch signals in response to the octave data $\overline{O2}$ and $\overline{O1}$ supplied by GA 2. The relationship between the output signal from terminal X and octave data $\overline{O2}$ and $\overline{O1}$ is shown in Table 3. For example, if the octave data $\overline{O2}$ and $\overline{O1}$ is 01, octave selector 7-1 selects the pitch signal connected to the input terminal X1. That is, the pitch signal outputted from the output terminal Q1 of the binary counter 6 is selected.

Now, the difference in frequency between the each output of octave selectors 7-1 through 7-4 is one octave, because the same octave data O2 and O1 is applied to control the octave selectors 7-1 through 7-4, but the inputs to terminals X0 through X3 of octave selectors 7-1, 7-2, 7-3, 7-4 are one octave different from each other. This is also true for terminals X1 through X3 of the octave selectors 7-1 through 7-4. The pitch signals outputted by octave selectors 7-1 through 7-4 are modulated in amplitude by the keyers 8-1 through 8-4. The output from the keyer 8-1 is outputted from TG 4-1 as 2' tone signal. The outputs from the keyers 8-2 through 8-4 are distributed to the specified tone color filters through the busbar selectors 9-1 through 9-3 as 4', 8', 16' tone signals respectively according to the octave data applied to the busbar selectors 9-1, 9-2, and 9-3. Here, the busbar selectors 9-1 through 9-3 distribute the input signal as shown in Table 4. In other words, the busbar selectors 9-1 through 9-3 output the tone signal from terminal X0 when the octave data is 00, from terminal X1 when the octave data is 01, from terminal X2 when the octave data is 10, from terminal X3 when the octave data is 11.

If one tries to use the TG surrounded by the dotted line as the quint series TG, TG 4-1 has the following defects.

TGs 4-1 through 4-n operate correctly when both note data and octave data are as shown in Table 1 and 2 respectively. Therefore, when the C1 key is pressed, TG 4-1 operates correctly as the quint series TG if GA 2 supplies note data 1000 and octave data 00, instead of note data 0001 and octave data 00. As shown in Table 5, octave data $\overline{O1}$, $\overline{O2}$ is 00 for C1 through E1, but octave data must be 01 for F1 through B1. That is, octave data for the note names F through B are equal to the octave data for the note names C through E plus one, respectively. Therefore, the octave data from F4 through B4 must be a repetition of C4 through E4 for the octave data consists of 2 bit digital signals. That means the frequency of the tone signal for F4 through B4 is the same as the frequency of the tone signal for F3 through B3 respectively.

Concerning the distribution of the pitch signals outputted by the busbar selectors 9-1 through 9-3, terminal X0 outputs 5 pitch signals (C1 through E1), but the terminal X3 outputs 19 pitch signals (F3 through B3, C4 through B4). This means the tone color filter connected to the terminal X3 has to take care of 19 tone signals. Therefore, the tone color of the highest tone signal outputted by that tone color filter is different from the tone color of the lowest tone signal outputted by that tone color filter.

Because the tone color filter is selected by the octave data, it outputs the same number of tone signals if the octave data for quint series TG and the octave data for octave series TG are the same. But in that case, the TG generates a tone signal one octave lower than it is supposed to generate for the keys F through B.

SUMMARY OF THE INVENTION

This invention is made to solve the defects described above.

Therefore, an object of the present invention is to provide an electronic musical instrument that can generate octave series tone signals and non-octave series (e.g. quint series) tone signals by using a common circuit configuration or a common assignment signal.

This object can be accomplished by an electronic musical instrument comprising: a generator assigner which outputs assignment signals composed of note data representing the name of the particular note whose tone signal has been designated by a particular key stroke, and octave data representing the octave number of the selected tone; and at least one tone generator which has at least one pitch signal generator and at least one octave controller, wherein said pitch signal generator is controlled by the above mentioned note data and generates the highest frequency pitch signal corresponding to the note name of the tone selected, and further, at least one of said at least one tone generator produces plural signals by dividing said highest frequency pitch signal, and wherein said octave controller is controlled by said octave data and selects pitch signals from said plural signals, and said pitch signals have octave numbers corresponding to the tone selected, and further, this octave controller contains a circuit for modifying the octave number of the pitch signals in accordance with said note data.

BRIEF DESCRIPTION OF THE DRAWINGS

The present invention will be clear by the following detailed description considered together with the accompanying drawings in which.

DESCRIPTION OF THE PREFERRED EMBODIMENTS

Figure 1:
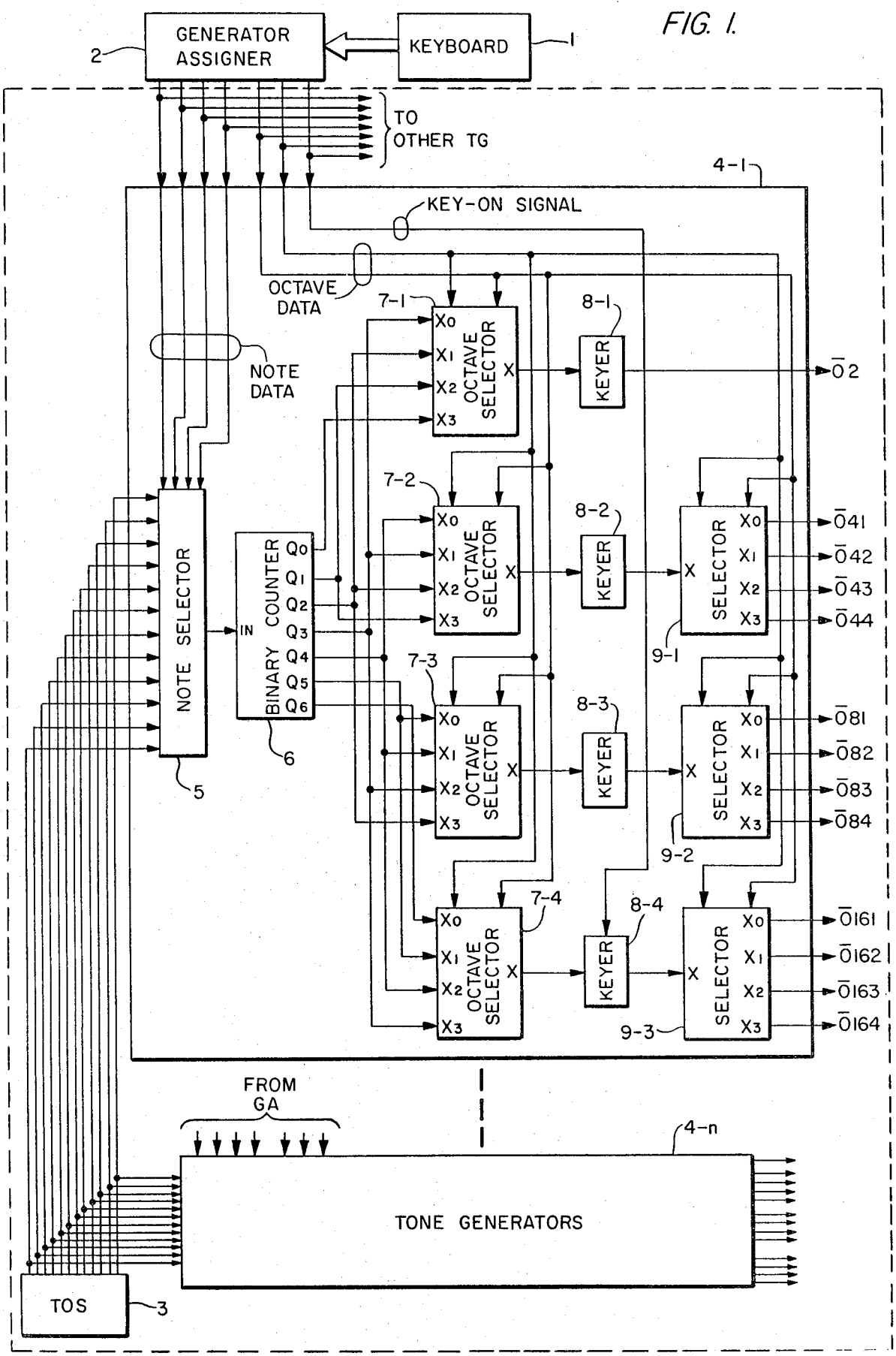
FIG. 1 is a block diagram of a conventional EMI using the key assigner system.
Figure 2:
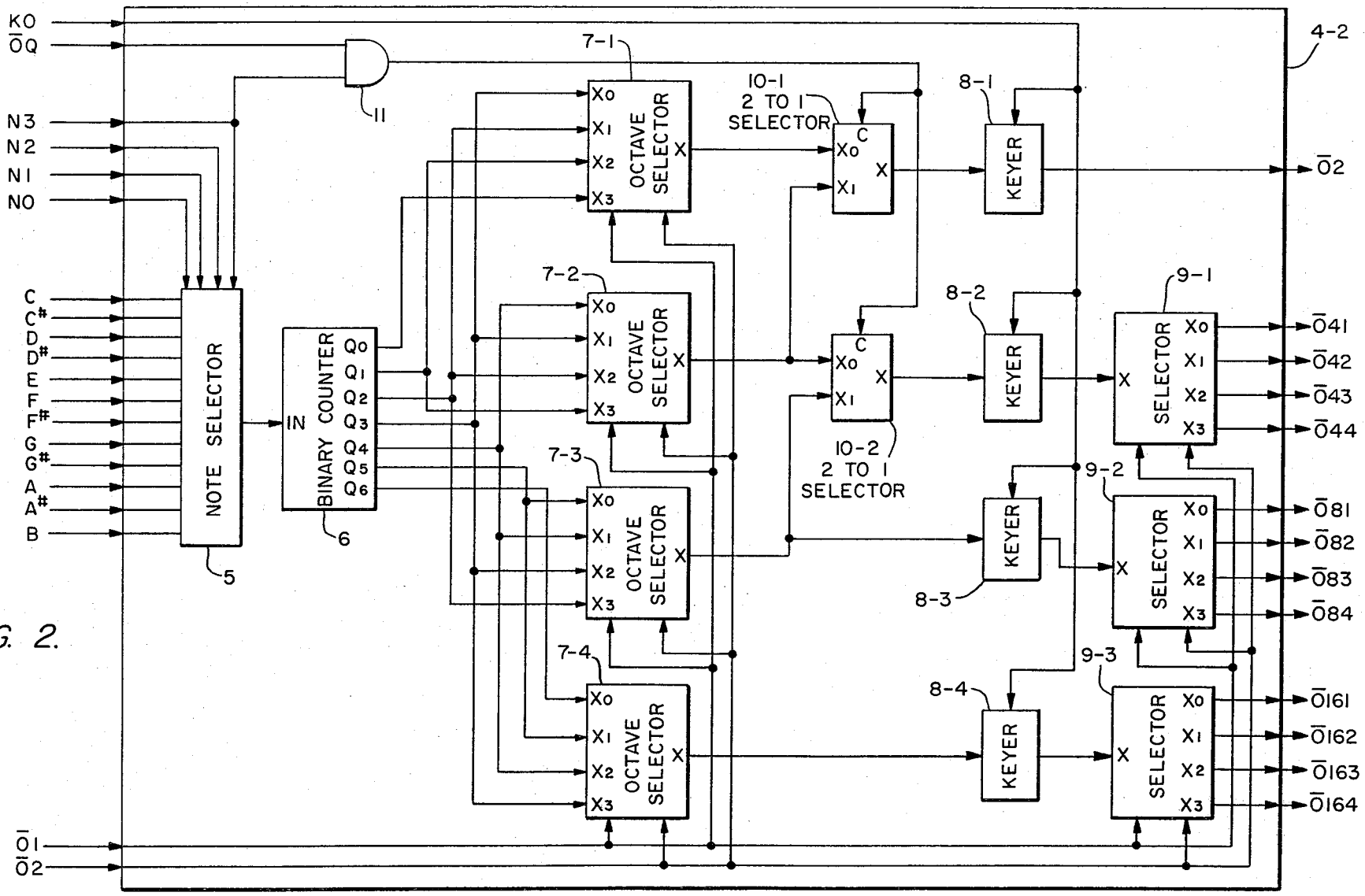
FIG. 2 is a block diagram of an embodiment of the present invention.

FIG. 2 shows the embodiment of the present invention. Refering to FIG. 2, Element 4-2 is the TG which generates tone signals according to the assignment signals supplied by GA 2. Element 5 is the note selector which selects one highest pitch signal out of the 12 highest pitch signals (C, C#, - - - , B) sent from TOS 3. The relationship between the output signal and the note data N3, N2, N1, N0 is shown in Table 1. Element 6 is a binary counter. The binary counter 6 divides the highest pitch signal obtained by the note selector 5 and supplies 7 pitch signals from the terminal Q0 through Q6. Element 7-1 through 7-4 are octave selectors which select one pitch signal out of 4 pitch signals sent from the terminals Q0 through Q3, Q1 through Q4, Q2 through Q5, Q3 through Q6 respectively of the binary counter 6 according to the octave data $\overline{O2}$, $\overline{O1}$. The function of octave selectors 7-1 through 7-4 is the same as that shown in FIG. 1. Element 10-1 and 10-2 are 2 to 1 selectors which select one signal out of 2 signals inputted to the terminals X0 and X1 according to the control signal supplied by AND gate 11. The function of 2 to 1 selectors 10-1 and 10-2 is shown in Table 7. Element 8-1 through 8-4 are keyers which control the amplitude of the input signal. Element 9-1 through 9-3 are busbar selectors which function the same fashion as the ones shown in FIG. 1.

The operation of the circuit shown in FIG. 2 is as follows.

When the key is pressed, GA 2 supplies the assignment signals that correspond to the key being pressed to the TG 4-2. Here, the assignment signals consist of N3, N2, N1, N0, $\overline{O2}$, $\overline{O1}$, and K0, wherein N3 through N0 represent note data, $\overline{O2}$ and $\overline{O1}$ represent octave data, and K0 indicates whether the key is being pressed or not. According to the assignment signals supplied by GA 2, the first note selector 5 selects one pitch signal out of 12 the highest pitch signals generated by TOS 3. This signal is divided into 7 pitch signals by the binary counter 6 and outputted from the terminals Q0 through Q6. The relationship in frequency of the output from the terminals Q0 through Q6 is as shown in the equation (1). These signals are supplied to the octave selectors 7-1 through 7-4, whereas: the outputs from the terminals Q0 through Q3 of the binary counter 6 are connected to the input terminals X3 through X0 respectively of the octave selector 7-1, and the outputs from the terminals Q1 through Q4 of the binary counter 6 are connected to the input terminals X3 through X0 respectively of the octave selector 7-2, the output from the terminals Q2 through Q5 of the binary counter 6 are connected to the input terminals X3 through X0 respectively of the octave selector 7-3, and the output from the terminals Q3 through Q6 of the binary counter 6 are connected to the input terminals X3 through X0 respectively of the octave selector 7-4.

Each of the octave selectors selects one out of its 4 inputs according to the octave data $\overline{O}2$ and $\overline{O}1$. Here, as described in FIG. 1, the output of the octave selector 7-1 is applied to the terminal X0 of the 2 to 1 selector 10-1, the output of the octave selector 7-2 is applied to the terminal X1 of the 2 to 1 selector 10-1 and the terminal X0 of the 2 to 1 selector 10-2, the output of the octave selector 7-3 is applied to the terminal X1 of the 2 to 1 selector 10-2 and to the keyer 8-3, and the output of the octave selector 7-4 is applied to the keyer 8-4 only. The 2 inputs X0 and X1 of the 2 to 1 selectors 10-1 and 10-2 differ by one octave from each other; therefore, when the control signal connected to the terminal C is "0", the outputs of the 2 to 1 selectors 10-1 and 10-2 are one octave higher than the output when the control signal is "1". The control signal applied to the terminal C is the logical product of the Most Significant Bit (MSB) of note data (which is N3) and the "octave series/quint series switching signal" (for further description, abbreviated as the $\overline{O}/Q$ signal). When the $\overline{O}/Q$ signal $\overline{O}Q$ is "0", the TG 4-2 operates as the octave series TG, when and $\overline{O}/Q$ signal $\overline{O}Q$ is "1", the TG operates as the quint series TG.

To use the TG 4-2 as the octave series TG, "0" must be given as the $\overline{O}/Q$ signal. Then the output of the AND gate 11 is always "0" so that each of the 2 to 1 selectors 10-1 and 10-2 always outputs the signal supplied to the terminal X0. This situation is exactly the same as the operation shown in FIG. 1.

To use the TG 4-2 as the quint series TG, "1" should be given as the $\overline{O}/Q$ signal. The output from the AND gate 11 is equal to the MSB of note data N3. Therefore the signal which controls the 2 to 1 selectors 10-1 and 10-2 are equal to the note data N3. In the circuit as described above, if GA 2 supplies the note data shown in Table 5 and the octave data shown in Table 2, TG 4-2 will output the $2\frac{2}{3}'$ tone signal from the output terminal $\overline{O}2$, and the $5\frac{1}{3}'$ tone signal from output terminals 041 through $\overline{O}44$ without any defects described in FIG. 1. For example, GA 2 supplies 0001 as the note data, and 00 as the octave data when the key for F1 is pressed. (The output terminals $\overline{O}81$ through $\overline{O}84$ and $\overline{O}161$ through $\overline{O}164$ output signals but they are not used in this embodiment.)

The details of the operation are described as follows.

Suppose the $\overline{O}/Q$ signal $\overline{O}Q$ is "1", then the output of AND gate 11 is equal to the note data N3. If the C1 key is pressed in the keyboard 1, then GA 2 supplies 1000 as the note data and 00 as the octave data. According to the note data, note selector 5 selects the highest pitch signal of the G note generated by TOS 3. The binary counter 6 divides the signal sent from note selector 5 and produces 7 octave pitch signals. Octave data $\overline{O}2$, $\overline{O}1$'s values are both 0 here, and the octave selectors 7-1 through 7-4 output the pitch signal supplied to the terminals X0. Therefore, the octave selectors 7-1, 7-2, and 7-3 respectively output the pitch signals sent from the terminals Q3, Q4, Q5, of the binary counter 6. The outputs of octave selectors 7-1 through 7-3 are applied to the 2 to 1 selectors 10-1 and 10-2. Now the control signal of the 2 to 1 selectors 10-1 and 10-2 involves for both: the input signal of AND gate 11, the $\overline{O}/Q$ signal $\overline{O}Q$, and the note data N3. When these three signals are all "1", the output of the AND gate 11 is "1", and the 2 to 1 selectors 10-1 and 10-2 select the input signal supplied to the terminal X1 and output from the terminal X. In other words, 2 to 1 selector 10-1 outputs the pitch signal supplied by the octave selector 7-2 which is equal to the output from the terminal Q4 of the binary counter 6, and the 2 to 1 selector 10-2 outputs the pitch signal supplied by the octave selector 7-3 which is equal to the output from the terminal Q5 of the binary counter 6. Therefore, the output signals O2 and O41 of the TG 4-2 are the signals sent from Q4 and Q5 respectively of the binary counter 6. The operation is the same for C#1 through E1 keys except the note data is different from the operation of the C1 key.

Next when the key F1 is pressed, GA 2 supplies 0001 as the note data, and 00 as the octave data to the TG 4-2. For the note selector 5, binary counter 6, and octave selectors 7-1 through 7-4, everything operates the same as the operation mentioned for the case when the key C1 is pressed, except the note selector 5 selects the highest pitch signal of G instead of C. Therefore, the input terminals X0 and X1 of the 2 to 1 selector 10-1 receive the pitch signal outputted by the terminals Q3 and Q4 respectively of the binary counter 6, and the input terminals X0 and X1 of the 2 to 1 selector 10-2 receive the pitch signal outputted by the terminal Q4 and Q5 respectively of the binary counter 6. Now, concerning the control signal applied to the 2 to 1 selectors 10-1 and 10-2, when the MSB of the note data (N3), which is then the input of the AND gate 11, is "0", the output of the AND gate 11 is always "0". Therefore, the 2 to 1 selectors 10-1 and 10-2 output the signal applied to the terminal X0, and TG 4-2 outputs the pitch signal sent from the terminals Q5 and Q4 of the binary counter 6 from the output terminals $\overline{O}2$ and $\overline{O}41$, respectively. As a result, the outputs from the keyers 8-1 through 8-4 are the same as when GA 2 supplied 0001 as the note data and 01 as the octave data in FIG. 1. But concerning the busbar selector, because it is not necessary to change the octave data as the note name changes from C, to C#, to - - - , to B, as shown in Table 5, the number of pitch signals outputted from each output terminal of the busbar selectors 9-1 through 9-3 is the same and there is no unbalance of distribution.

When the high frequency keys, such as F4 through B4, are pressed, the octave data $\overline{O}2$, $\overline{O}1$ are both 1 (in FIG. 1, it must be 100 which is impossible to express with the 2 bit octave data $\overline{O}2$, $\overline{O}1$) therefore, the repetition of the pitch signal does not occur.

Figure 3:
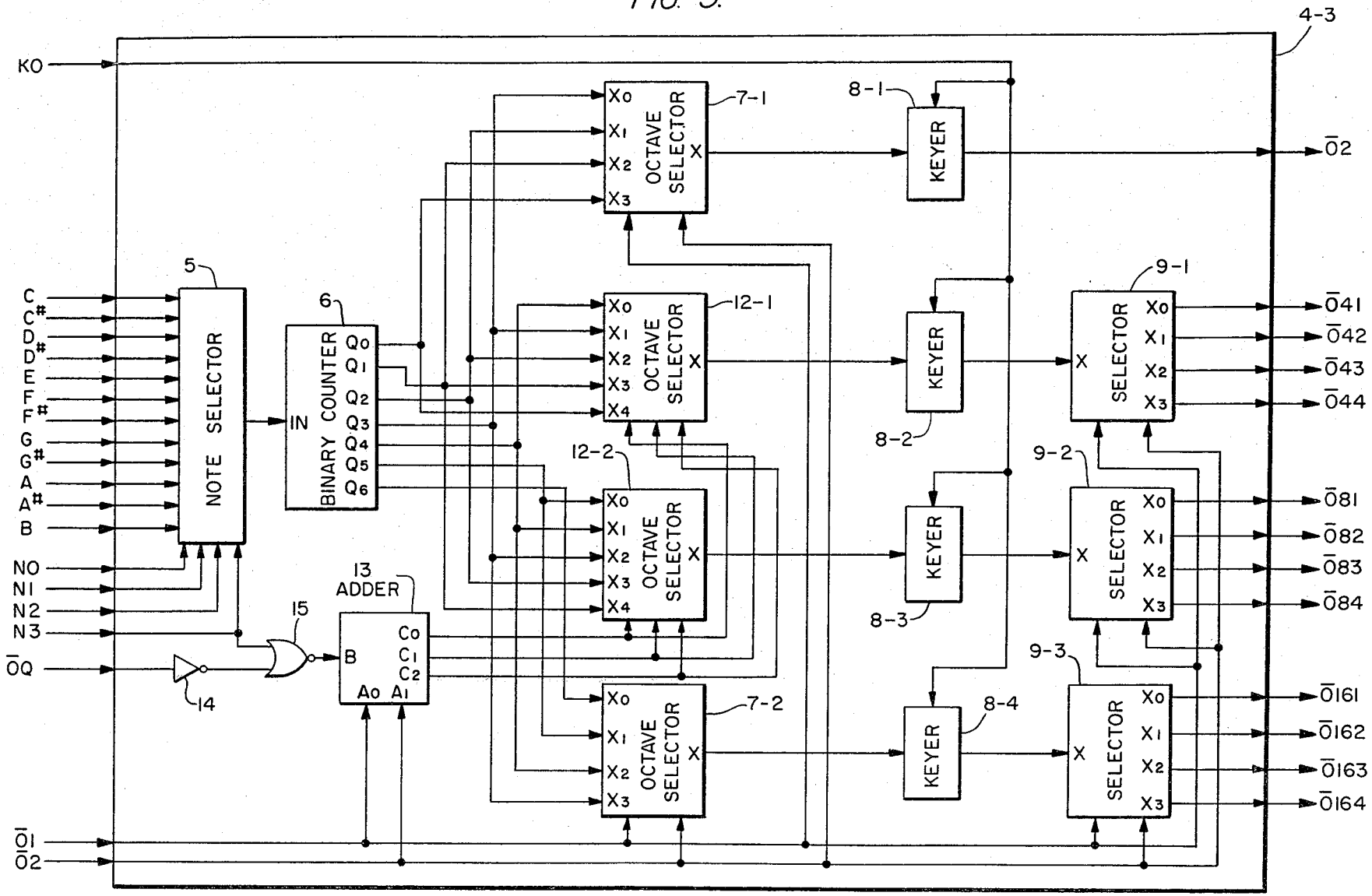
FIG. 3 is a block diagram of another embodiment of the present invention.
Figure 4:
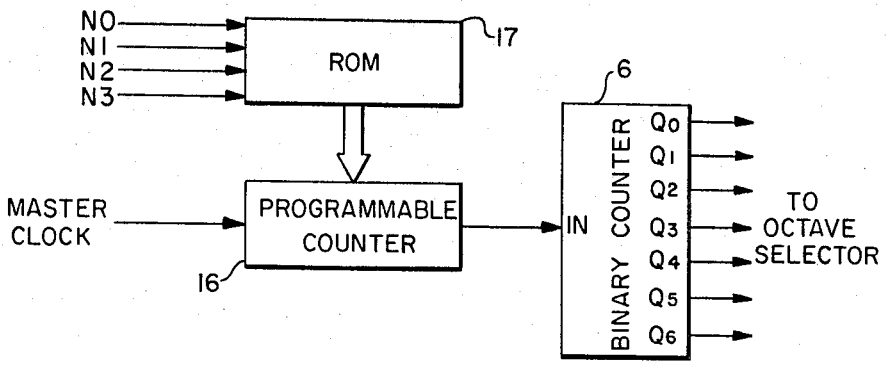
FIGS. 4 and 5 are block diagrams of circuits for obtaining tone signals having octave relationships with each other.

FIG. 3 shows another embodiment of the present invention. Referring to FIG. 3, 4-3 is a TG, 5 is a note selector, 6 is a binary counter, 7-1 and 7-2 are octave selectors, 8-1 through 8-4 are keyers, and 9-1 through 9-3 are busbar selectors. The operation of the above elements is similar to what is shown in FIGS. 1 and 2. Elements 12-1 and 12-2 are octave selectors, in this case the octave selectors 12-1 and 12-2 have 3 bits control input. Element 13 is an adder. Here, the relationship between inputs and outputs of adder 13 and octave selectors 12-1 and 12-2 are as shown in Tables 8 and 9, respectively.

The operation of the circuit shown in FIG. 3 is as follows.

According to the note data N3 through N4, note selector 5 selects one of the highest frequency pitch signals C through B which are generated by TOS 3. The selected highest frequency pitch signal is then divided into 7 pitch signals and outputted from the terminals Q0 through Q6 by binary counter 6. The octave selectors 7-1, 7-2, 12-1 and 12-2 select one pitch signal out of Q0 through Q6.

The operation of octave selectors 12-1 and 12-2 is as follows.

The $\overline{O}/Q$ signal $\overline{O}Q$ is applied to the inverter 14, and the output of the inverter 14 and the MSB of the note data N3 are applied to the NOR gate 15. The output of the NOR gate 15 is then applied to the input B of the adder 13. The adder 13 outputs the addition of octave data $\overline{O}2$, $\overline{O}1$, which is applied to inputs A0 and A1, and the output of the NOR gate 15, which is applied to the input B, to control the octave selectors 12-1 and 12-2. Therefore, when $\overline{O}/Q$ signal $\overline{O}Q$ is "0", NOR gate 15 is always "0", and the outputs of the adder 13 outputs, C0, C1 and C2, are equal to octave data $\overline{O}1$, octave data $\overline{O}2$, and "0", respectively. In other words, octave selectors 12-1 and 12-2 output the signal applied to input terminal X0 from the output terminal X while octave selectors 7-1, 7-2 output the signal applied to input terminal X0 from the output terminal X. This operation of the octave selectors 12-1, 12-2, 7-1 and 7-2 is exactly the same as octave series TG.

When the $\overline{O}/Q$ signal $\overline{O}Q$ is "1" the situation is as follows.

The output of the NOR gate 15 is the inverse of note data N3 so that, as shown in Table 10, the output is "0" when the keys C through E are pressed and is "1" when keys F through B are pressed. This output is connected to the adder 13. The adder 13 outputs octave data without any change when the keys C through E are pressed, and the adder 13 outputs the sum of 1 and octave data when the keys F through B are pressed. Therefore, octave selectors 12-1 and 12-2 select a pitch signal one octave higher for F through B keys compared with C through E keys. The operation of the octave selectors 12-1 and 12-2 is similar to that of 2 to 1 selectors 10-1 and 10-2 shown in FIG. 2. Thus, the octave selectors 12-1 and 12-2 respectively output pitch signals for $2\frac{2}{3}'$, $5\frac{1}{3}'$. The operation of the keyers 8-1 through 8-4 and the busbar selectors 9-1 through 9-3 is the same as that previously described for FIG. 2.

Figure 7:
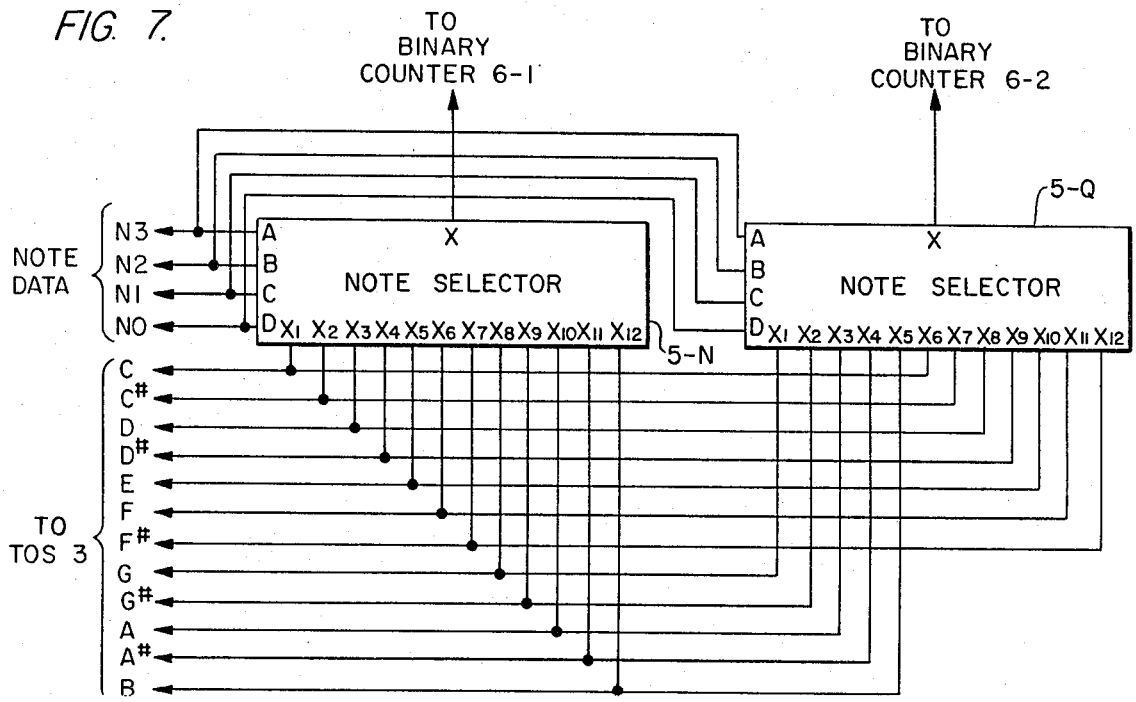
FIG. 7 is a connection diagram of note selectors.

Besides, in the embodiments shown in FIG. 2 and FIG. 3, 7 pitch signals (the outputs of the binary counter 6) are obtained by dividing the highest pitch signals selected out of 12 highest pitch signals (C through B) supplied from the TOS 3 by the note selector 5. This operation performed by the TOS 3, the note selector 5, and the binary counter 6 may be performed by the circuit shown in FIG. 4 or FIG. 5.

In the embodiment shown in FIG. 4, element 16 is a programmable counter. It divides the master clock by N to obtain the highest pitch signal of the note specified by the key stroke. The value of N is determined by the data supplied by the Read Only Memory (ROM) 17. The ROM 17 has the note data N3 through N0 as addressing inputs. Therefore, the value of N of the programmable counter 16 varies according to the note data in order to obtain the highest pitch signal of the note specified by the key stroke. Binary counter 6 divides the highest pitch signal obtained by the programmable counter 16 to output 7 pitch signals.

Figure 5:
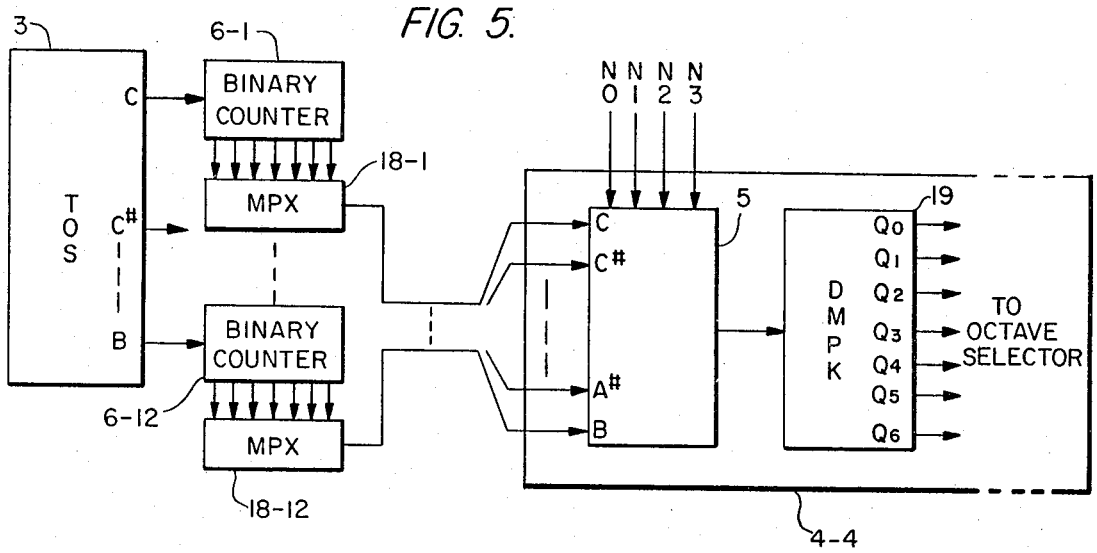

In the embodiment shown in FIG. 5, the binary counters 6-1 through 6-12 divide the highest pitch signal supplied by TOS 3 to respectively obtain the 7 pitch signals. The multiplexers (MPX) 18-1 through 18-12 respectively multiplex the 7 pitch signals supplied by the binary counters 6-1 through 6-12. Then, in TG 4-4, note selector 5 selects one of the multiplexed pitch signals according to the note data. Demultiplexer (DMPX) 19 demultiplexes the signal supplied by the note selector 5 to obtain the 7 pitch signals.

Besides, the programmable counter 16 may be a usual type of programmable counter, such as RCA's CMOS integrated circuit CD-4059A.

Figure 6:
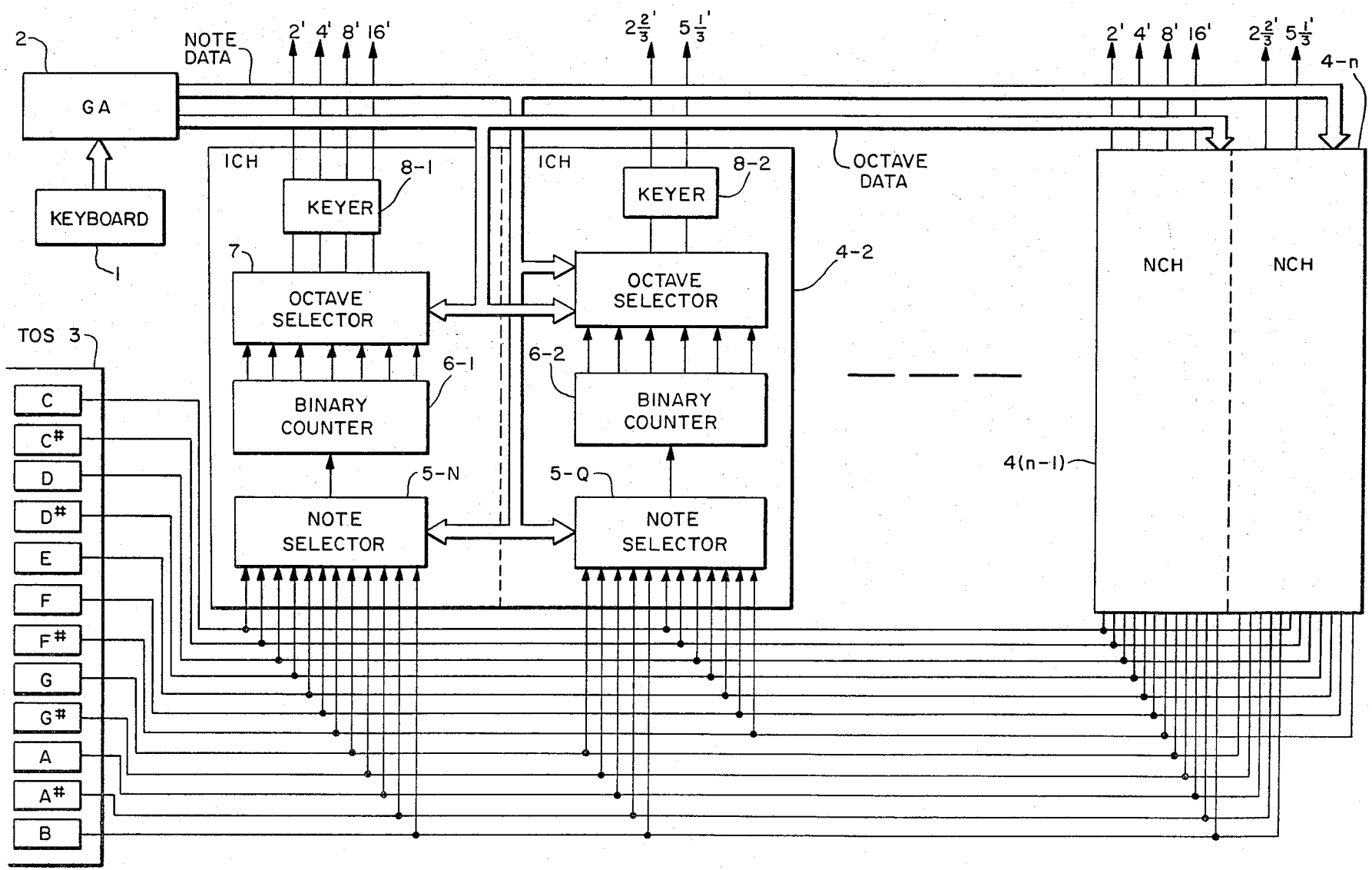
FIG. 6 is a block diagram of still another embodiment of the present invention.

FIG. 6 is another embodiment of the present invention. For the device or circuit which operates the same as described previously, the same notation is used and no detail description is repeated. Referring to FIG. 6, the TG 4-1 is the TG for the octave series, and the TG 4-2 is the TG for the quint series. In the following description, the assignment signals supplied by the GA 2 are assumed to be the same as shown in Table 1 and 2.

TG 4-1 and 4-2 operate as follows. At the moment of the key stroke, GA 2 supplied assignment signals to TG 4-1 and 4-2. Note selectors 5-N and 5-Q each select the highest pitch signal sent from TOS 3 according to the note data. In this embodiment, the same note data is supplied to both note selectors 5-N and 5-Q; however, each note selector is made to select different highest pitch signals. FIG. 7 shows the detail of note selectors 5-N and 5-Q. In FIG. 7, the note selectors 5-N and 5-Q are the same circuit, and select one out of 12 inputs (X1 through X12) according to the control signal (here, the note data N3 through N0) applied to terminals A through D. The truth table of this note selector is shown in Table 11. As shown in FIG. 7, the inputs to the note selector 5-Q (the highest pitch signals C through F#) are shifted to the right and the highest pitch signals G through B are respectively connected to the terminals X1 through X5 so as to select the highest pitch signal different from that selected by note selector 5-N, even though it is controlled by the same note data.

TG 4-1, which is for octave series TG, has no difference from the usual TG. The operation of the quint series TG 4-2 is as follows:

As mentioned earlier, the note selector 5-Q selects the highest pitch signal from several pitch signals to supply them to octave selector 20. GA 2 supplies the octave data and note data to TG 4-2. The octave data is the same as that supplied to octave selector 7. The note data is the same as that one supplied to note selector 5-N. Therefore, the octave selector 20 selects pitch signals determined by octave data as shown in Table 2 and modified by note data to supply keyer 8-2. Keyer 8-2 then controls the amplitude of pitch signals output from TG 4-2.

Describing octave selector 20, when the note data is 0110 through 1100, which means the keys F through B are pressed, it selects the pitch signal whose octave number is one octave higher than the octave number determined only by the octave data. Therefore, TG 4-2 generates pitch signals naturally so that the output from octave selector 20 rises a half tone without lowering one octave when the key E, then the key F (which is next to the key E) are pressed.

By constraining the TG to operate as described, the problem of the TG generating pitch signals one octave lower than it should is avoided. Both the octave series tone signals and the quint series tone signals can be obtained without increasing the TOS.

Figure 8:
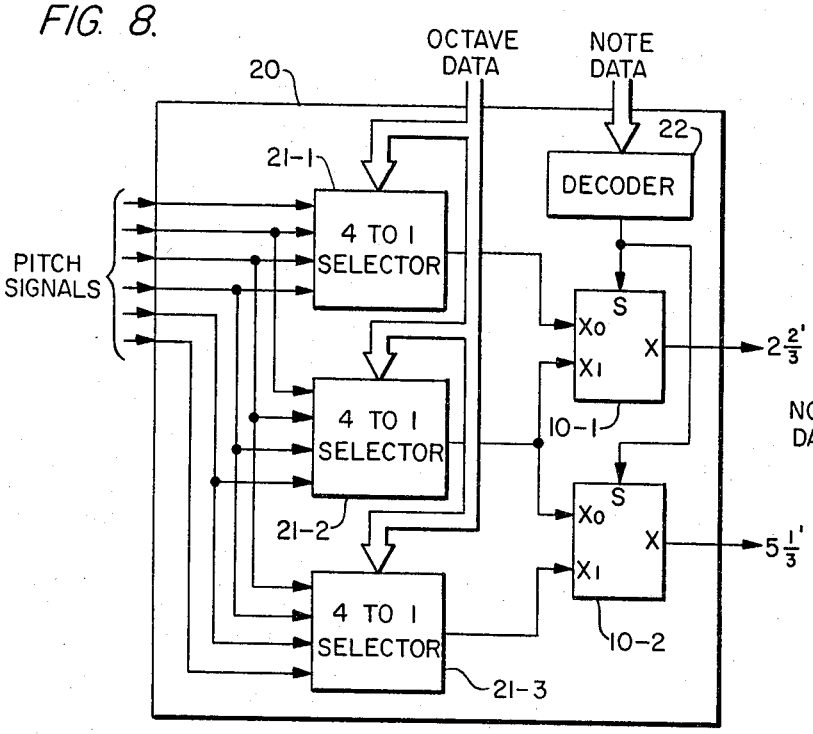
FIG. 8 is a block diagram of an embodiment of an octave selector.

FIG. 8 shows an embodiment of the octave selector 20 shown in FIG. 6. Referring to FIG. 8, 21-1 through 21-3 are 4 to 1 selectors which select one out of 4 inputs according to the octave data. 22 is a decoder which outputs "1" or "0" according to the note data. The truth table of the decoder 22 is shown in Table 12 (col. of decoder 22).

The operation of what is shown in FIG. 8 is as follows.

Each of 4 to 1 selectors 21-1 through 21-3 selects one pitch signal from the 4 pitch signals supplied to them according to the octave data. Each of the outputs of the 4 to 1 selectors 21-1 through 21-3 differs by one octave, and the input to terminal X0 of the 2 to 1 selectors 10-1 and 10-2 is one octave higher than the input to terminal X1. Note data is applied to decoder 22 to control the outputs of the octave selector 20. The decoder can be a logic circuit such as that shown in FIG. 9.

Figure 10:
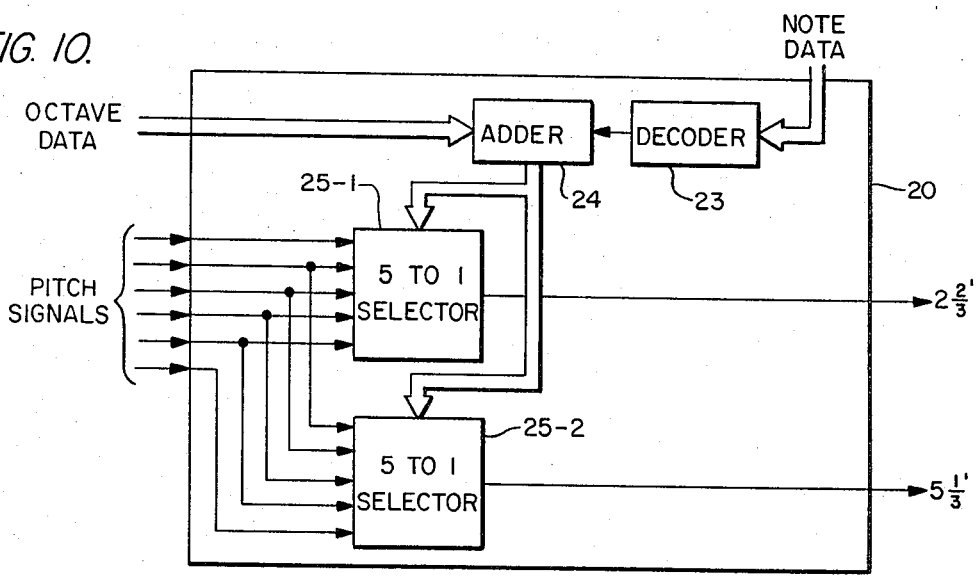
FIG. 10 is a logic diagram of another embodiment of an octave selector.

FIG. 10 is another embodiment of the quint series octave selector 20 shown in FIG. 6. In FIG. 10, element 23 is a decoder which outputs "0" or "1" according to note data, and its truth table is shown in Table 12 (col. of decoder 23). Element 24 is an adder which takes the sum of the octave data and the output of decoder 23. Element 25-1 and 25-2 are 5 to 1 selectors which select one pitch signal out of 5 pitch signals according to adder 24.

The operation of what is shown in FIG. 10 is as follows.

When the note data is 0110 through 1100, decoder 23 supplies a "1" to adder 24. Adder 24 then adds 1 to the octave data and supplies it to the 5 to 1 selectors 25-1 and 25-2 to select pitch signals which are one octave higher than the pitch signals determined by the original octave data.

Figure 9:
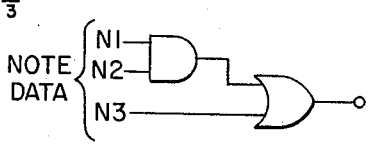
FIG. 9 is a logic diagram of a decoder shown in FIG. 8.

Besides, the decoder circuit shown in FIG. 9 is only for the case when the GA 2 supplies the note data as shown in Table 1. It is obvious that the note data may be encoded in any format; therefore if note data were determined as shown in Table 13, then the MSB of the note data, which means the data N3, can control the 2 to 1 selectors 10-1 and 10-2 directly.

In the description noted above, the embodiment shown selects pitch signals which are one octave higher according to the note data by controlling the octave data or the octave selector. But the TG could easily and naturally be constructed so as to have an octave selector which selects a pitch signal out of pitch signals which are made one octave higher beforehand according to the note data.

Figure 11:
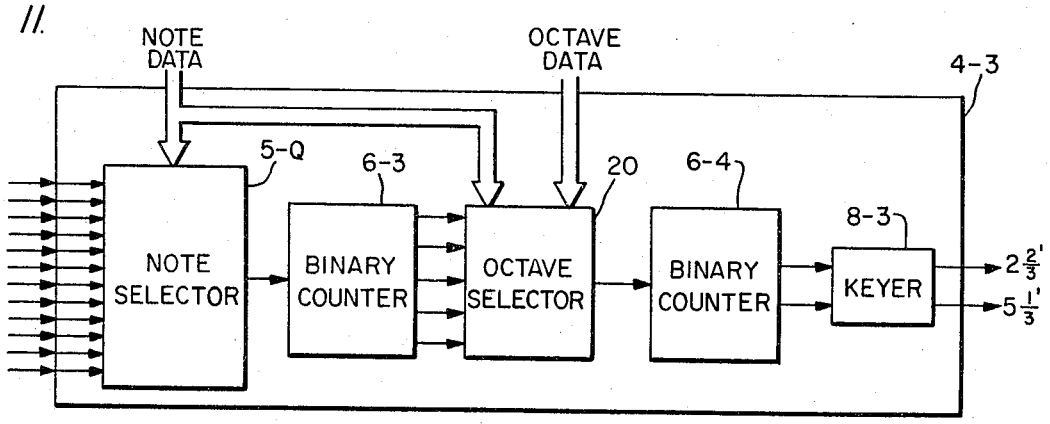
FIG. 11 is a block diagram for selecting a pitch signal according to note data.

FIG. 11 is an embodiment for the case when the octave selector selects the pitch signal out of pitch signals which are made one octave higher beforehand according to the note data. In FIG. 11, an input signal of binary counter 6-4 is selected by both the octave data and the note data and supplied to the octave selector 20.

As described above, by controlling the octave number of pitch signals with both octave data and note data, the present invention will provide octave series tone signals and quint series tone signals without designing another TG circuit. For the quint series tone signals, they are not pure temperament so that tone signals are not beating when they do not occur. It is not necessary to raise the frequency of the clock signal as described in the usual EMI, and therefore, a device for high frequency signals is not necessary. The same octave data can be applied to both the octave series TG and the quint series TG without generating any pitch signal which has the wrong octave number; therefore, the unbalance in distribution by busbar selectors is avoided without any hardware.

TABLE 1

| NOTE NAME | NOTE DATA $N_3$ | $N_2$ | $N_1$ | $N_0$ |
|---|---|---|---|---|
| C | 0 | 0 | 0 | 1 |
| C# | 0 | 0 | 1 | 0 |
| D | 0 | 0 | 1 | 1 |
| D# | 0 | 1 | 0 | 0 |
| E | 0 | 1 | 0 | 1 |
| F | 0 | 1 | 1 | 0 |
| F# | 0 | 1 | 1 | 1 |
| G | 1 | 0 | 0 | 0 |
| G# | 1 | 0 | 0 | 1 |
| A | 1 | 0 | 1 | 0 |
| A# | 1 | 0 | 1 | 1 |
| B | 1 | 0 | 0 | 0 |

TABLE 2

| OCTAVE RANGE | OCTAVE DATA $\bar{02}$ | $\bar{01}$ |
|---|---|---|
| 1 | 0 | 0 |
| 2 | 0 | 1 |
| 3 | 1 | 0 |
| 4 | 1 | 1 |

TABLE 3

| OCTAVE DATA $\bar{02}$ | $\bar{01}$ | OUTPUT X |
|---|---|---|
| 0 | 0 | $X_0$ |
| 0 | 1 | $X_1$ |
| 1 | 0 | $X_2$ |
| 1 | 1 | $X_3$ |

TABLE 4

| OCTAVE DATA $\bar{02}$ | $\bar{01}$ | OUTPUT $X_0$ | $X_1$ | $X_2$ | $X_3$ |
|---|---|---|---|---|---|
| 0 | 0 | X | — | — | — |
| 0 | 1 | — | X | — | — |
| 1 | 0 | — | — | X | — |
| 1 | 1 | — | — | — | X |

—: HIGH IMPEDANCE

TABLE 5

| | $N_3$ | $N_2$ | $N_1$ | $N_0$ | $\bar{02}$ | $\bar{01}$ | | $N_3$ | $N_2$ | $N_1$ | $N_0$ | $\bar{02}$ | $\bar{01}$ | | $N_3$ | $N_2$ | $N_1$ | $N_0$ | $\bar{02}$ | $\bar{01}$ | | $N_3$ | $N_2$ | $N_1$ | $N_0$ | $\bar{02}$ | $\bar{01}$ |
|---|---|---|---|---|---|---|---|---|---|---|---|---|---|---|---|---|---|---|---|---|---|---|---|---|---|---|---|
| $C_1$ | 1 | 0 | 0 | 0 | 0 | 0 | $C_2$ | 1 | 0 | 0 | 0 | 0 | 1 | $C_3$ | 1 | 0 | 0 | 0 | 1 | 0 | $C_4$ | 1 | 0 | 0 | 0 | 1 | 1 |
| $C_1$# | 1 | 0 | 0 | 1 | 0 | 0 | $C_2$# | 1 | 0 | 0 | 1 | 0 | 1 | $C_3$# | 1 | 0 | 0 | 1 | 1 | 0 | $C_4$# | 1 | 0 | 0 | 1 | 1 | 1 |
| $D_1$ | 1 | 0 | 1 | 0 | 0 | 0 | $D_2$ | 1 | 0 | 1 | 0 | 0 | 1 | $D_3$ | 1 | 0 | 1 | 0 | 1 | 0 | $D_4$ | 1 | 0 | 1 | 0 | 1 | 1 |
| $D_1$# | 1 | 0 | 1 | 1 | 0 | 0 | $D_2$# | 1 | 0 | 1 | 1 | 0 | 1 | $D_3$# | 1 | 0 | 1 | 1 | 1 | 0 | $D_4$# | 1 | 0 | 1 | 1 | 1 | 1 |
| $E_1$ | 1 | 1 | 0 | 0 | 0 | 0 | $E_2$ | 1 | 1 | 0 | 0 | 0 | 1 | $E_3$ | 1 | 1 | 0 | 0 | 1 | 0 | $E_4$ | 1 | 1 | 0 | 0 | 1 | 1 |
| $F_1$ | 0 | 0 | 0 | 1 | 0 | 1 | $F_2$ | 0 | 0 | 0 | 1 | 1 | 0 | $F_3$ | 0 | 0 | 0 | 1 | 1 | 1 | $F_4$ | 0 | 0 | 0 | 1 | 1 | 1 |
| $F_1$# | 0 | 0 | 1 | 0 | 0 | 1 | $F_2$# | 0 | 0 | 1 | 0 | 1 | 0 | $F_3$# | 0 | 0 | 1 | 0 | 1 | 1 | $F_4$# | 0 | 0 | 1 | 0 | 1 | 1 |
| $G_1$ | 0 | 0 | 1 | 1 | 0 | 1 | $G_2$ | 0 | 0 | 1 | 1 | 1 | 0 | $G_3$ | 0 | 0 | 1 | 1 | 1 | 1 | $G_4$ | 0 | 0 | 1 | 1 | 1 | 1 |

TABLE 5-continued

| | $N_3$ | $N_2$ | $N_1$ | $N_0$ | $\bar{0}2$ | $\bar{0}1$ | | $N_3$ | $N_2$ | $N_1$ | $N_0$ | $\bar{0}2$ | $\bar{0}1$ | | $N_3$ | $N_2$ | $N_1$ | $N_0$ | $\bar{0}2$ | $\bar{0}1$ | | $N_3$ | $N_2$ | $N_1$ | $N_0$ | $\bar{0}2$ | $\bar{0}1$ |
|---|---|---|---|---|---|---|---|---|---|---|---|---|---|---|---|---|---|---|---|---|---|---|---|---|---|---|---|
| $G_1$# | 0 | 1 | 0 | 0 | 0 | 1 | $G_2$# | 0 | 1 | 0 | 0 | 1 | 0 | $G_3$# | 0 | 1 | 0 | 0 | 1 | 1 | $G_4$# | 0 | 1 | 0 | 0 | 1 | 1 |
| $A_1$ | 0 | 1 | 0 | 1 | 0 | 1 | $A_2$ | 0 | 1 | 0 | 1 | 1 | 0 | $A_3$ | 0 | 1 | 0 | 1 | 1 | 1 | $A_4$ | 0 | 1 | 0 | 1 | 1 | 1 |
| $A_1$# | 0 | 1 | 1 | 0 | 0 | 1 | $A_2$# | 0 | 1 | 1 | 0 | 1 | 0 | $A_3$# | 0 | 1 | 1 | 0 | 1 | 1 | $A_4$# | 0 | 1 | 1 | 0 | 1 | 1 |
| $B_1$ | 0 | 1 | 1 | 1 | 0 | 1 | $B_2$ | 0 | 1 | 1 | 1 | 1 | 0 | $B_3$ | 0 | 1 | 1 | 1 | 1 | 1 | $B_4$ | 0 | 1 | 1 | 1 | 1 | 1 |

TABLE 6

| terminal | output tone signals |
|---|---|
| $X_0$ | $C_1, \ldots, E_1$ |
| $X_1$ | $F_1, \ldots, B_1, C_2, \ldots, E_2$ |
| $X_2$ | $F_2, \ldots, B_2, C_3, \ldots, E_3$ |
| $X_3$ | $F_3, \ldots, B_3, C_4, \ldots, B_4$ |

TABLE 7

| INPUT | | | OUTPUT |
|---|---|---|---|
| $X_0$ | $X_1$ | C | X |
| 0 | — | 0 | 0 |
| 1 | — | 0 | 1 |
| — | 0 | 1 | 0 |
| — | 1 | 1 | 1 |

TABLE 8

| INPUT | | | OUTPUT | | |
|---|---|---|---|---|---|
| $A_1$ | $A_0$ | B | $C_2$ | $C_1$ | $C_0$ |
| $X_1$ | $X_0$ | 0 | 0 | $X_1$ | $X_0$ |
| 0 | 0 | 1 | 0 | 0 | 1 |
| 0 | 1 | 1 | 0 | 1 | 0 |
| 1 | 0 | 1 | 0 | 1 | 1 |
| 1 | 1 | 1 | 1 | 0 | 0 |

TABLE 9

| INPUT | | | OUTPUT |
|---|---|---|---|
| $C_2$ | $C_1$ | $C_0$ | X |
| 0 | 0 | 0 | $X_0$ |
| 0 | 0 | 1 | $X_1$ |
| 0 | 1 | 0 | $X_2$ |
| 0 | 1 | 1 | $X_3$ |
| 1 | 0 | 0 | $X_4$ |

TABLE 10

| KEY PRESSED | OUTPUT of NOR GATE |
|---|---|
| C | 0 |
| C# | 0 |
| D | 0 |
| D# | 0 |
| E | 0 |
| F | 1 |
| F# | 1 |
| G | 1 |
| G# | 1 |
| A | 1 |
| A# | 1 |
| B | 1 |

TABLE 11

| TRUTH TABLE | | | | |
|---|---|---|---|---|
| CONTROL INPUTS | | | | OUTPUT |
| A | B | C | D | X |
| 0 | 0 | 0 | 1 | $X_1$ |
| 0 | 0 | 1 | 0 | $X_2$ |
| 0 | 0 | 1 | 1 | $X_3$ |
| 0 | 1 | 0 | 0 | $X_4$ |
| 0 | 1 | 0 | 1 | $X_5$ |
| 0 | 1 | 1 | 0 | $X_6$ |
| 0 | 1 | 1 | 1 | $X_7$ |
| 1 | 0 | 0 | 0 | $X_8$ |

TABLE 11-continued

| TRUTH TABLE | | | | |
|---|---|---|---|---|
| CONTROL INPUTS | | | | OUTPUT |
| A | B | C | D | X |
| 1 | 0 | 0 | 1 | $X_9$ |
| 1 | 0 | 1 | 0 | $X_{10}$ |
| 1 | 0 | 1 | 1 | $X_{11}$ |
| 1 | 1 | 0 | 0 | $X_{12}$ |

TABLE 12

| TRUTH TABLE OF DECODER | | | | | |
|---|---|---|---|---|---|
| NOTE DATA | | | | OUTPUT | |
| $N_3$ | $N_2$ | $N_1$ | $N_0$ | DECODER 22 | DECODER 23 |
| 0 | 0 | 0 | 1 | 1 | 0 |
| 0 | 0 | 1 | 0 | 1 | 0 |
| 0 | 0 | 1 | 1 | 1 | 0 |
| 0 | 1 | 0 | 0 | 1 | 0 |
| 0 | 1 | 0 | 1 | 1 | 0 |
| 0 | 1 | 1 | 0 | 0 | 1 |
| 0 | 1 | 1 | 1 | 0 | 1 |
| 1 | 0 | 0 | 0 | 0 | 1 |
| 1 | 0 | 0 | 1 | 0 | 1 |
| 1 | 0 | 1 | 0 | 0 | 1 |
| 1 | 0 | 1 | 1 | 0 | 1 |
| 1 | 1 | 0 | 0 | 0 | 1 |

TABLE 13

| | NOTE DATA | | | |
|---|---|---|---|---|
| NOTE NAME | $N_3$ | $N_2$ | $N_1$ | $N_0$ |
| C | 0 | 0 | 1 | 1 |
| C# | 0 | 1 | 0 | 0 |
| D | 0 | 1 | 0 | 1 |
| D# | 0 | 1 | 1 | 0 |
| E | 0 | 1 | 1 | 1 |
| F | 1 | 0 | 0 | 0 |
| F# | 1 | 0 | 0 | 1 |
| G | 1 | 0 | 1 | 0 |
| G# | 1 | 0 | 1 | 1 |
| A | 1 | 1 | 0 | 0 |
| A# | 1 | 1 | 0 | 1 |
| B | 1 | 1 | 1 | 0 |

What is claimed is:

1. An electronic musical instrument comprising: a generator assigner which outputs assignment signals composed of note data representing the name of the particular note whose tone signal has been designated by a particular key stroke, and octave data representing the octave number of the selected tone; and at least one tone generator which has at least one pitch signal generating means and at least one octave controlling means, wherein said pitch signal generating means is controlled by said note data and generates the highest frequency pitch signal corresponding to the note name of the tone selected, and wherein at least one of said at least one tone generators produces plural signals by dividing said highest frequency pitch signal, and wherein said octave controlling means is controlled by said octave data and selects pitch signals from said plural signals, and said pitch signals have octave numbers corresponding to the tone selected, and said octave controlling means contains means for modifying the octave number of the pitch signals in accordance with said note data.

2. An electronic musical instrument as claimed in claim 1, wherein said octave controlling means contains means for choosing whether or not to modify the octave number of an outputted pitch signal in accordance with said note data.

3. An electronic musical instrument as claimed in claim 1, wherein at least one of said at least one tone generators contains at least two sets of said pitch signal generating means each of which supplies plural signals obtained by dividing the highest frequency pitch signal having a different note name, by the same assignment data sent from the generator assigner.

4. An electronic musical instrument as claimed in claim 1, wherein at least one of said at least one tone generators contains output selecting means controlled by said octave data and receives pitch signals supplied by said octave controlling means, so as to select the output terminal from which at least one of said at least one tone generators should output tone signals.

5. An electronic musical instrument as claimed in claim 1, wherein said octave controlling means comprises: a first means controlled by said octave data for selecting octave related plural pitch signals output from said pitch signal generating means; and a second means controlled by said note data for selecting and outputting pitch signals from said octave related plural pitch signals from said first means, whereby said selected pitch signals are outputted from at least one of said at least one tone generators.

6. An electronic musical instrument as claimed in claim 1, wherein said octave controlling means comprises: a first means controlled by said note data for selecting octave related plural pitch signals output from said pitch signal generating means; and a second means controlled by said octave data for selecting and outputting pitch signals from said octave related plural pitch signals from said first means, whereby said selected pitch signals are outputted from at least one of said at least one tone generators.

7. An electronic musical instrument as claimed in claim 1, wherein said octave controlling means comprises: a converting means which converts octave data according to said note data, and further comprises means for selecting outputted pitch signals having an octave number to be outputted from said tone generator from plural pitch signals obtained by said pitch signal generating means.

* * * * *